US011253094B1

(12) United States Patent
Deck

(10) Patent No.: US 11,253,094 B1
(45) Date of Patent: Feb. 22, 2022

(54) PARCEL STORAGE ASSEMBLY

(71) Applicant: Jerry Deck, Luttrell, TN (US)

(72) Inventor: Jerry Deck, Luttrell, TN (US)

( * ) Notice: Subject to any disclaimer, the term of this patent is extended or adjusted under 35 U.S.C. 154(b) by 0 days.

(21) Appl. No.: 17/123,199

(22) Filed: Dec. 16, 2020

(51) Int. Cl.
*A47G 29/124* (2006.01)
*A47G 29/14* (2006.01)
*A47G 29/30* (2006.01)
*A47G 29/22* (2006.01)

(52) U.S. Cl.
CPC ..... *A47G 29/1251* (2017.08); *A47G 29/141* (2013.01); *A47G 29/22* (2013.01); *A47G 29/30* (2013.01)

(58) Field of Classification Search
CPC ..... A47G 29/141; A47G 29/22; A47G 29/30; A47G 29/12095; A47G 29/1248; A47G 29/1251; A47G 2029/1257; A47G 2029/145; A47G 2029/148; A47G 2029/149
USPC ..... 232/45, 47, 48, 51, 19; 340/569
See application file for complete search history.

(56) References Cited

U.S. PATENT DOCUMENTS 132,865 A * 11/1872 Sinclaire ..... A47G 29/12095 232/48
400,299 A * 3/1889 Chappell et al. ..... A47G 29/12095 232/48
413,928 A * 10/1889 Cook ..... A47G 29/1207 232/48
465,867 A * 12/1891 Lindsay ..... A47G 29/16 232/24
741,865 A * 10/1903 Williams ..... A47G 29/12095 232/48
807,764 A * 12/1905 Mowers et al. . A47G 29/12095 232/48
1,111,031 A * 9/1914 Petri ..... A47G 29/12095 232/48
2,770,516 A 11/1956 Mestre
3,401,875 A 9/1968 Bruhns
3,735,919 A 5/1973 Morgan
3,802,619 A * 4/1974 Vanderveer ..... A47G 29/1225 232/17
4,724,999 A * 2/1988 Fitzgerald ..... A47G 29/12095 232/17
4,753,386 A * 6/1988 Phillion, Sr. ..... A47G 29/121 232/43.1
4,905,891 A * 3/1990 Wildish ..... A47G 29/12095 232/17
5,435,484 A 7/1995 Carlson
(Continued)

FOREIGN PATENT DOCUMENTS

WO WO2011043826 4/2011

*Primary Examiner* — William L Miller

(57) ABSTRACT

A parcel storage assembly includes a box that has an upper door and a lower door. A first tray and a second tray is each pivotally integrated into the box. The first tray and the second tray are positioned in a deployed position for having the parcel positioned thereon when the upper door is opened. The first tray and the second tray are each positioned in a stored position when the upper door is closed in order to drop the parcel downwardly in the box. An alert unit is integrated into the box and the alert unit detects when the parcel falls into the box. The alert unit broadcasts an alert signal to the personal electronic device when the alert unit detects the parcel to alert the authorized recipient that the parcel has been deposited into the box.

14 Claims, 6 Drawing Sheets

(56) References Cited

U.S. PATENT DOCUMENTS

| | | | | |
|---|---|---|---|---|
| 5,774,053 | A * | 6/1998 | Porter | F25D 23/10 340/568.1 |
| 6,244,505 | B1 | 6/2001 | Grimes | |
| 6,719,195 | B2 * | 4/2004 | Farentinos | A47G 29/22 232/45 |
| 6,799,716 | B1 * | 10/2004 | Kuelbs | A47G 29/12095 232/39 |
| 7,249,705 | B2 | 7/2007 | Dudley | |
| 7,252,220 | B1 * | 8/2007 | Shreve | A47G 29/124 232/45 |
| 7,854,374 | B2 * | 12/2010 | Dudley | A47G 29/12095 232/45 |
| 7,946,472 | B2 * | 5/2011 | Bolles | A47G 29/22 232/45 |
| 8,573,473 | B1 * | 11/2013 | Farentinos | A47G 29/22 232/51 |
| 8,960,530 | B2 * | 2/2015 | Silke | A47G 29/22 232/47 |
| 9,004,346 | B2 * | 4/2015 | Farentinos | A47G 29/22 232/43.3 |
| 10,251,503 | B1 * | 4/2019 | Fulps | A47G 29/12 |
| 2015/0297013 | A1 * | 10/2015 | Bolles | A47G 29/1251 232/17 |
| 2017/0035232 | A1 * | 2/2017 | Sandlin | A47G 29/22 |
| 2017/0286905 | A1 * | 10/2017 | Richardson | G06Q 10/0832 |
| 2020/0107664 | A1 * | 4/2020 | Yang | A47G 29/30 |
| 2020/0237131 | A1 * | 7/2020 | Conaway | A47G 29/1212 |

* cited by examiner

PARCEL STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage device and more particularly pertains to a new storage device for securing a parcel for an authorized recipient. The storage device additionally broadcasts an alert to a personal electronic device to alert the authorized recipient that the parcel has been delivered.

(2) Description of Related Art Including Information Disclosed Under 37 CFR 1.97 and 1.98

The prior art relates to storage device including a variety of drop boxes which included hinged trap doors for dropping a parcel into a box while inhibiting the parcel from being removed by an unauthorized person. The prior art discloses a mail slot in a home which includes a trap door for inhibiting a parcel from being removed from outside.

BRIEF SUMMARY OF THE INVENTION

An embodiment of the disclosure meets the needs presented above by generally comprising a box that has an upper door and a lower door. A first tray and a second tray is each pivotally integrated into the box. The first tray and the second tray are positioned in a deployed position for having the parcel positioned thereon when the upper door is opened. The first tray and the second tray are each positioned in a stored position when the upper door is closed in order to drop the parcel downwardly in the box. An alert unit is integrated into the box and the alert unit detects when the parcel falls into the box. The alert unit broadcasts an alert signal to the personal electronic device when the alert unit detects the parcel to alert the authorized recipient that the parcel has been deposited into the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
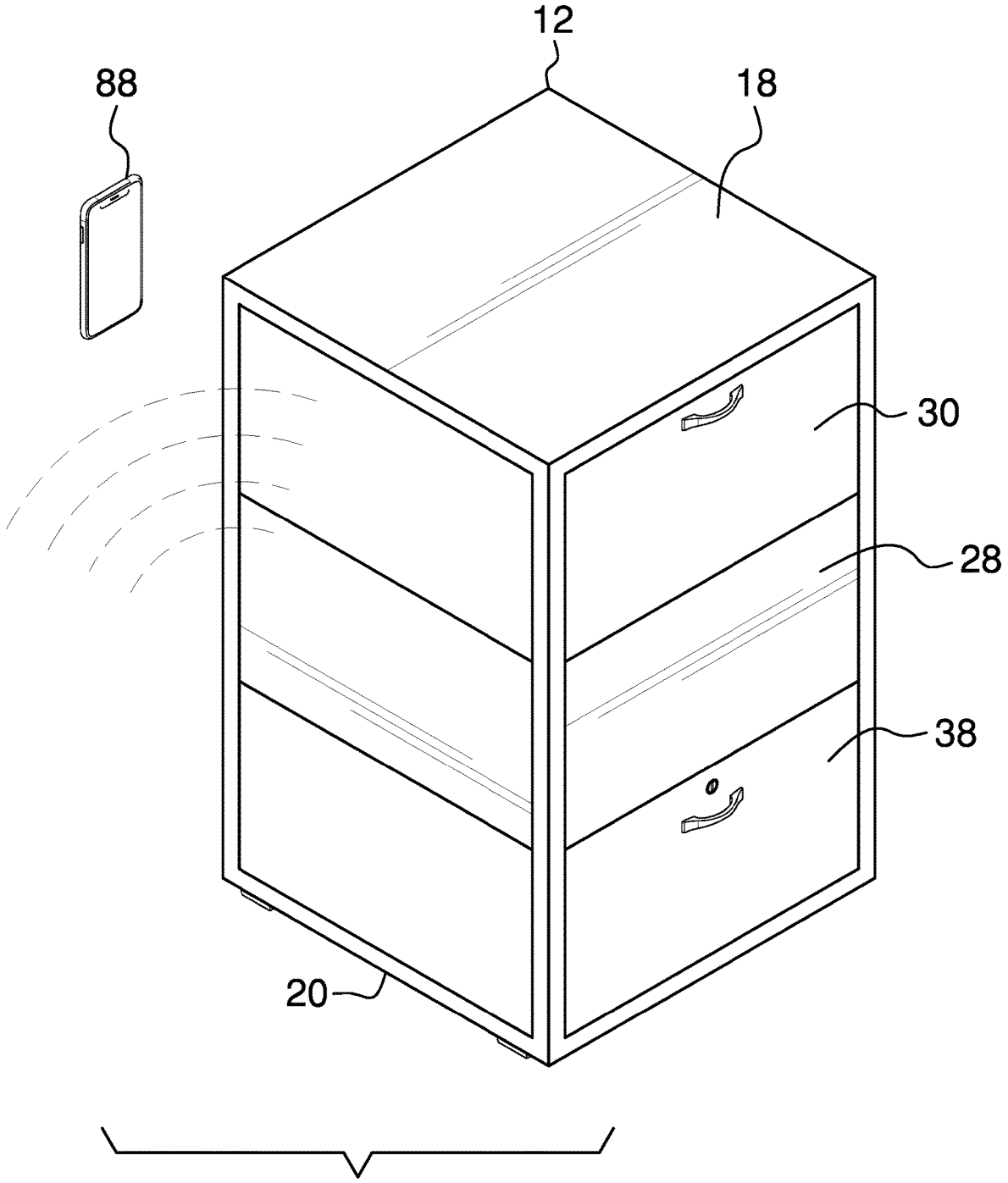
FIG. 1 is a perspective view of a parcel storage assembly according to an embodiment of the disclosure.
Figure 2:
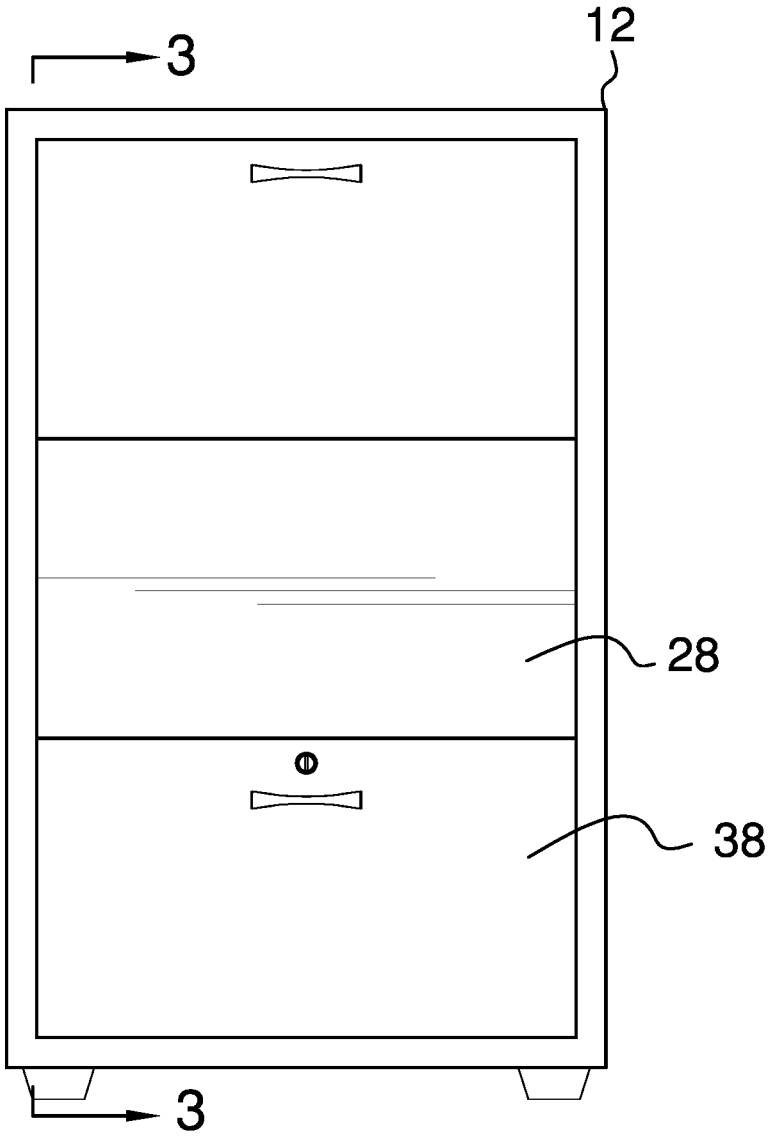
FIG. 2 is a front view of an embodiment of the disclosure.
Figure 3:
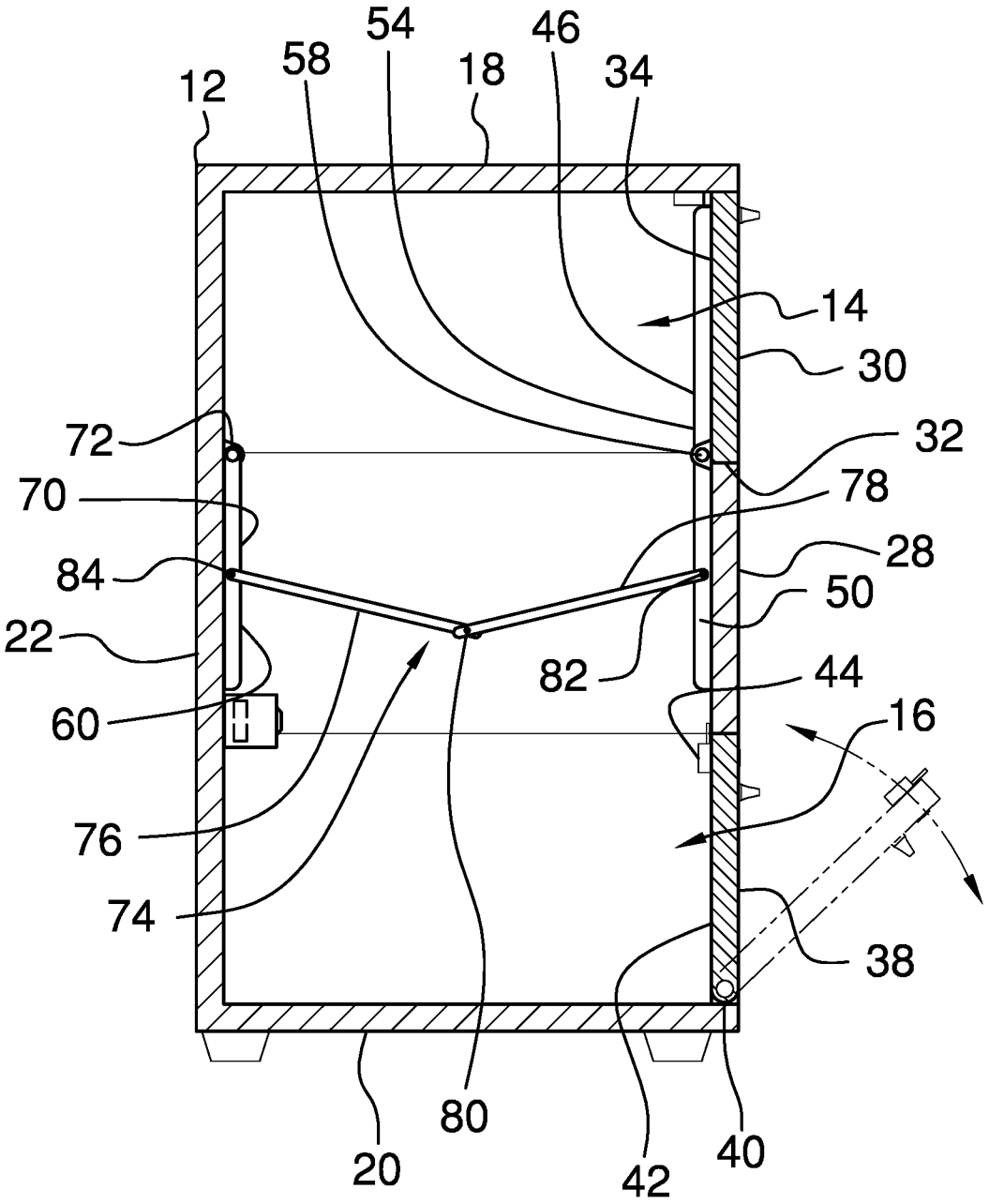
FIG. 3 is a cross sectional view taken along line 3-3 of FIG. 2 of an embodiment of the disclosure showing a first tray and a second tray in a stored position.
Figure 4:
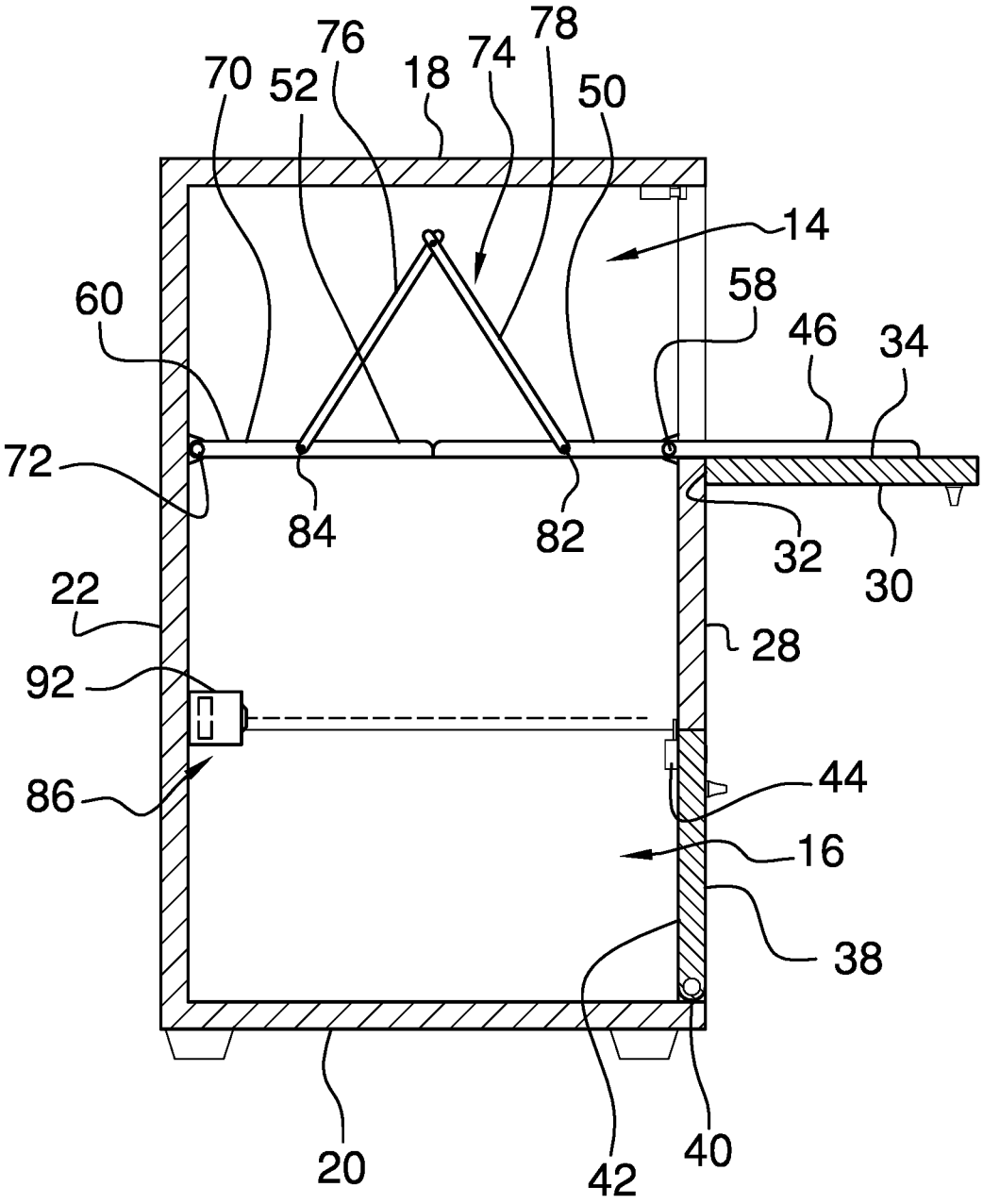
FIG. 4 is a cross sectional view taken along line 3-3 of FIG. 2 of an embodiment of the disclosure showing a first tray and a second tray in a deployed position.
Figure 5:
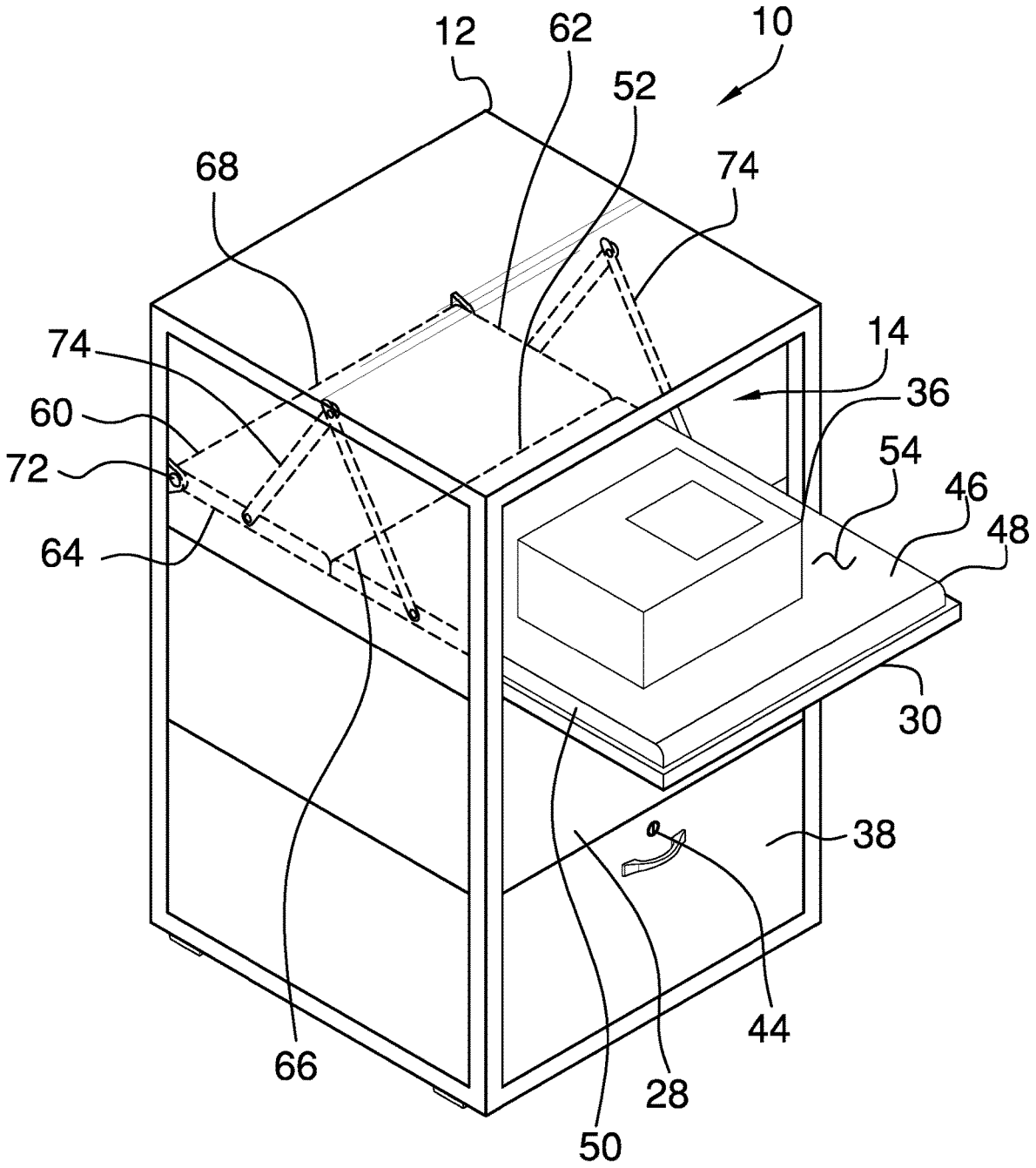
FIG. 5 is a perspective view of an embodiment of the disclosure showing a parcel being positioned on a second tray for subsequent deposit into a box.
Figure 6:
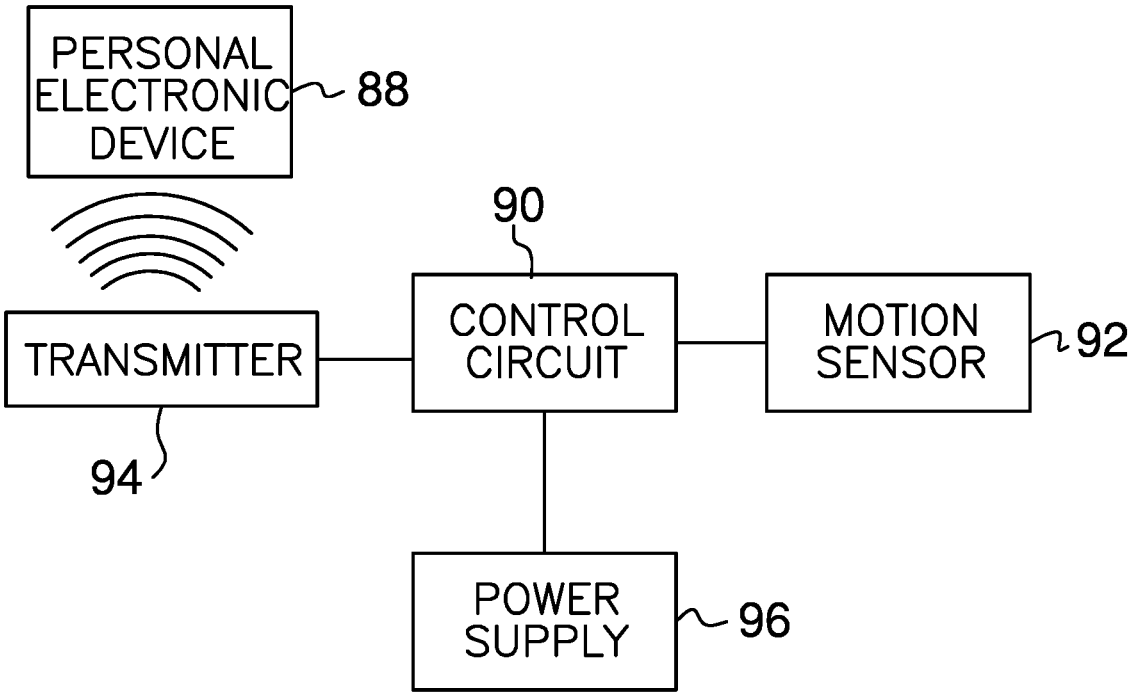
FIG. 6 is a schematic view of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the parcel storage assembly 10 generally comprises a box 12 that has an upper slot 14 extending into an interior of the box 12 and a lower slot 16 extending into the interior of the box 12. The box 12 has a top wall 18, a bottom wall 20 and an outer wall 22 extending therebetween, and the outer wall 22 has a first lateral side 24, a second lateral side 26 and a front side 28. Each of the upper slot 14 and the lower slot 16 extends through the front side 28, the upper slot 14 is positioned adjacent to the top wall 18, and the lower slot 16 is positioned adjacent to the bottom wall 20. An upper door 30 is hingedly coupled to the box 12 and the upper door 30 is aligned with the upper slot 14 for opening and closing the upper slot 14. The upper door 30 has a lower edge 32 and a first surface 34, and the lower edge 32 is hingedly coupled to the front side 28 of the outer wall 22. The first surface 34 lies on a horizontal plane when the upper door 30 is positioned in an open position.

A lower door 38 is hingedly coupled to the box 12 and the lower door 38 is aligned with the lower slot 16 for opening and closing the lower slot 16. The lower door 38 has a bottom edge 40 and a primary surface 42, and the bottom edge 40 is hingedly coupled to the front side 28 of the outer wall 22. The primary surface 42 lies on a horizontal plane when the lower door 38 is positioned in an open position. A lock 44 is integrated into the lower door 38 and the lock 44 engages the outer wall 22 of the box 12 when the lock 44 is locked for inhibiting the lower door 38 from being opened. In this way the lock 44 can secure a parcel 36 in the box 12. The lock 44 disengages the outer wall 22 of the box 12 when the lock 44 is unlocked to facilitate an authorized recipient to retrieve the parcel 36.

A first tray 46 is pivotally integrated into the box 12 and the first tray 46 is positionable in a stored position or a deployed position. The first tray 46 extends outwardly through the upper slot 14 when the first tray 46 is in the deployed position. The first tray 46 is urged into the open position when the upper door 30 is opened thereby facilitating the parcel 36 to be positioned on the first tray. Moreover, the first tray 46 is vertically oriented when the first tray 46 is in the stored position to drop the parcel 36 into the box 12. The first tray 46 is urged into the stored position when the upper door 30 is closed. The first tray 46 has a first sidelong edge 48, a second sidelong edge 50, a back edge 52 and a primary surface 54. Each of the first sidelong edge 48 and the second sidelong edge 50 is pivotally coupled to an inside surface 56 of a respective one of the first lateral side 24 and the second lateral side 26 of the outer wall 22 of the box 12 at a respective pivot point 58. The pivot points 58 of the first tray 46 are centrally positioned on the respective first sidelong edge 48 and second sidelong edge 50.

A second tray 60 is pivotally integrated into the box 12 and the second tray 60 is in mechanical communication with the first tray 46. The second tray 60 is positioned in a deployed position when the first tray 46 is positioned in the deployed position to support the parcel 36. Additionally, the second tray 60 is positioned in a stored position when the first tray 46 is positioned in the stored position to drop the parcel 36 downwardly in the box 12. The second tray 60 has a primary sidelong edge 62, a secondary sidelong edge 64, a front edge 66, a rear edge 68 and a primary surface 70.

Each of the primary sidelong edge 62 and the secondary sidelong edge 64 is pivotally coupled to the inside surface 56 of a respective one of the first lateral side 24 and the second lateral side 26 of the outer wall 22 of the box 12 at a respective pivot point 72. The respective pivot points 72 of the second tray 60 are each positioned at an intersection between the rear edge 68 and the respective primary sidelong edge 62 and secondary sidelong edge 64. The front edge 66 of the second tray 60 is aligned with the back edge 52 of the first tray 46 when the first tray 46 and the second tray 60 are positioned in the deployed position. The primary surface 42 of the first tray 46 lies on a plane that is coplanar with the primary surface 70 of the second tray 60 when the first tray 46 and the second tray 60 are positioned in the deployed position.

A pair of linkages 74 is provided and each of the linkages 74 has a first arm 76 that is pivotally coupled to a second arm 78 at a pivot point 80. The first arm 76 has a distal end 82 and the second arm 78 has a distal end 84. The distal end 82 of the first arm 76 of each of the linkages 74 is pivotally coupled a respective first sidelong edge 48 and the second sidelong edge 50 of the first tray 46. Moreover, the distal end 84 of the second arm 78 of each of the linkages 74 is pivotally coupled to a respective primary sidelong edge 62 and the secondary sidelong edge 64 of the second tray 60. Each of the linkages 74 urges the second tray 60 into the deployed position when the first tray 46 is urged into the deployed position. Additionally, each of the linkages 74 urges the second tray 60 into the stored position when the first tray 46 is urged into the stored position.

An alert unit 86 is integrated into the box 12 and the alert unit 86 is in communication with an interior of the box 12. In this way the alert unit 86 can detect when the parcel 36 falls into the box 12. The alert unit 86 is in wireless communication with a personal electronic device 88 and the alert unit 86 broadcasts an alert signal to the personal electronic device 88 when the alert unit 86 detects the parcel 36. The personal electronic device 88 may be a smart phone or other type of device that is carried by the authorized recipient. In this way the alert unit 86 can alert the authorized recipient that the parcel 36 has been deposited into the box 12. The parcel 36 may be any package that has been delivered by a delivery person.

The alert unit 86 comprises a control circuit 90 that is integrated into the box 12 and the control circuit 90 receives an alert input. A motion sensor 92 is positioned within the box 12 to sense motion of the parcel 36 when the parcel 36 falls downwardly in the box 12. The motion sensor 92 is aligned with the lower door 38 and the motion sensor 92 is electrically coupled to the control circuit 90. Additionally, the control circuit 90 receives the alert input when the motion sensor 92 senses motion. The motion sensor 92 may be any electronic motion sensor 92 such as infra-red motion sensor 92 or any other type of motion sensor 92 that is capable of sensing the motion of the parcel 36 in the box 12.

The alert unit 86 includes a transmitter 94 that is integrated into the box 12 and the transmitter 94 is electrically coupled to the control circuit 90. The transmitter 94 is in wireless communication with the personal electronic device 88, and the transmitter 94 broadcasts the alert signal to the personal electronic device 88 when the control circuit 90 receives the alert input. The transmitter 94 may be a radio frequency transmitter or the like, and the transmitter 94 may be in wireless communication with an extrinsic communication network, such as the internet or a cellular phone network, for wirelessly communicating with the personal electronic device 88. A power supply 96 is integrated into the box 12, the power supply 96 is electrically coupled to the control circuit 90 and the power supply 96 comprises at least one battery.

In use, the delivery person opens the upper door 30 and slides the parcel 36 into the first tray 46 and the second tray 60. The parcel 36 is dropped when the delivery person closes the upper door 30. In this way the parcel 36 is secured in the box 12 for the authorized recipient to retrieve at their leisure. The alert unit 86 broadcasts the alert signal to the personal electronic device 88 to alert the authorized recipient that the parcel 36 has been delivered. The authorized recipient can unlock the lock 44 on the lower door 38 and retrieve the parcel 36 from the box 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

I claim:

1. A parcel storage assembly for securely storing a parcel, said assembly comprising:

a box having an upper slot extending into an interior of said box and a lower slot extending into said interior of said box;

an upper door being hingedly coupled to said box, said upper door being aligned with said upper slot for opening and closing said upper slot;

a lower door being hingedly coupled to said box, said lower door being aligned with said lower slot for opening and closing said lower slot;

a first tray being pivotally integrated into said box, said first tray being positionable in a stored position or a deployed position, said first tray extending outwardly through said upper slot when said first tray is in said deployed position, said first tray being urged into said open position when said upper door is opened wherein said first tray is configured to have the parcel positioned thereon, said first tray being vertically oriented when said first tray is in said stored position wherein said first tray is configured to drop the parcel into said box, said first tray being urged into said stored position when said upper door is closed;

a second tray being pivotally integrated into said box, said second tray being in mechanical communication with said first tray, said second tray being positioned in a deployed position whens said first tray is positioned in said deployed position wherein each of said first tray and said second tray is configured to support the parcel, said second tray being positioned in a stored position when said first tray is positioned in said stored position wherein each of said first tray and said second tray is configured to drop the parcel downwardly in said box; and an alert unit being integrated into said box, said alert unit being in communication with an interior of said box wherein said alert unit is configured to detect when the parcel falls into said box, said alert unit being in wireless communication with a personal electronic device, said alert unit broadcasting an alert signal to the personal electronic device when said alert unit detects the parcel wherein said alert unit is configured to alert the authorized recipient that the parcel has been deposited into said box.

2. The assembly according to claim 1, wherein said box has a top wall, a bottom wall and an outer wall extending therebetween, said outer wall having a first lateral side, a second lateral side and a front side, each of said upper slot and said lower slot extending through said front side, said upper slot being positioned adjacent to said top wall, said lower slot being positioned adjacent to said bottom wall.

3. The assembly according to claim 2, wherein said upper door has a lower edge and a first surface, said lower edge being hingedly coupled to said front side of said outer wall, said first surface lying on a horizontal plane when said upper door is positioned in an open position.

4. The assembly according to claim 2, wherein said lower door has a bottom edge and a primary surface, said bottom edge being hingedly coupled to said front side of said outer wall, said primary surface lying on a horizontal plane when said lower door is positioned in an open position wherein said primary surface is configured to support a parcel being inserted into said box for storage.

5. The assembly according to claim 2, further comprising a lock being integrated into said lower door, said lock engaging said outer wall of said box when said lock is locked for inhibiting said lower door from being opened wherein said lock is configured to secure the parcel in said box, said lock disengaging said outer wall of said box when said lock is unlocked wherein said lock is configured to facilitate an authorized recipient to retrieve the parcel.

6. The assembly according to claim 2, wherein said first tray has a first sidelong edge, a second sidelong edge, a back edge and a primary surface, each of said first sidelong edge and said second sidelong edge being pivotally coupled to an inside surface of a respective one of said first lateral side and said second lateral side of said outer wall of said box at a respective pivot point.

7. The assembly according to claim 6, wherein:

said second tray has a primary sidelong edge, a secondary sidelong edge, a front edge and a primary surface, each of said primary sidelong edge and said secondary sidelong edge being pivotally coupled to said inside surface of a respective one of said first lateral side and said second lateral side of said outer wall of said box at a respective pivot point; and said front edge of said second tray is aligned with said back edge of said first tray when said first tray and said second tray are positioned in said deployed position, said primary surface of said first tray lying on a plane being coplanar with said primary surface of said second tray when said first tray and said second tray are positioned in said deployed position.

8. The assembly according to claim 7, further comprising a pair of linkages, each of said linkages having a first arm being pivotally coupled to a second arm at a pivot point, said first arm having a distal end, said second arm having a distal end, said distal end of said first arm of each of said linkages being pivotally coupled a respective first sidelong edge and said second sidelong edge of said first tray, said distal end of said second arm of each of said linkages being pivotally coupled to a respective primary sidelong edge and said secondary sidelong edge of said second tray.

9. The assembly according to claim 8, wherein each of said linkages urges said second tray into said deployed position when said first tray is urged into said deployed position, each of said linkages urging said second tray into said stored position when said first tray is urged into said stored position.

10. The assembly according to claim 1, wherein said alert unit comprises a control circuit being integrated into said box, said control circuit receiving an alert input.

11. The assembly according to claim 10, wherein said alert unit includes a motion sensor being positioned within said box wherein said motion sensor is configured to sense motion of the parcel when said parcel falls downwardly in said box, said motion sensor being aligned with said lower door, said motion sensor being electrically coupled to said control circuit, said control circuit receiving said alert input when said motion sensor senses motion.

12. The assembly according to claim 10, wherein said alert unit includes a transmitter being integrated into said box, said transmitter being electrically coupled to said control circuit, said transmitter being in wireless communication with the personal electronic device, said transmitter broadcasting said alert signal to the personal electronic device when said control circuit receives said alert input.

13. The assembly according to claim 10, wherein said alert unit includes a power supply being integrated into said box, said power supply being electrically coupled to said control circuit, said power supply comprising at least one battery.

14. A parcel storage assembly for securely storing a parcel, said assembly comprising:

a box having an upper slot extending into an interior of said box and a lower slot extending into said interior of said box, said box having a top wall, a bottom wall and an outer wall extending therebetween, said outer wall having a first lateral side, a second lateral side and a front side, each of said upper slot and said lower slot extending through said front side, said upper slot being positioned adjacent to said top wall, said lower slot being positioned adjacent to said bottom wall;

an upper door being hingedly coupled to said box, said upper door being aligned with said upper slot for opening and closing said upper slot, said upper door having a lower edge and a first surface, said lower edge being hingedly coupled to said front side of said outer wall, said first surface lying on a horizontal plane when said upper door is positioned in an open position;

a lower door being hingedly coupled to said box, said lower door being aligned with said lower slot for opening and closing said lower slot, said lower door having a bottom edge and a primary surface, said bottom edge being hingedly coupled to said front side of said outer wall, said primary surface lying on a horizontal plane when said lower door is positioned in an open position wherein said primary surface is configured to support a parcel being inserted into said box for storage;

a lock being integrated into said lower door, said lock engaging said outer wall of said box when said lock is locked for inhibiting said lower door from being opened wherein said lock is configured to secure the parcel in said box, said lock disengaging said outer wall of said box when said lock is unlocked wherein said lock is configured to facilitate an authorized recipient to retrieve the parcel;

a first tray being pivotally integrated into said box, said first tray being positionable in a stored position or a deployed position, said first tray extending outwardly through said upper slot when said first tray is in said deployed position, said first tray being urged into said open position when said upper door is opened wherein said first tray is configured to have the parcel positioned thereon, said first tray being vertically oriented when said first tray is in said stored position wherein said first tray is configured to drop the parcel into said box, said first tray being urged into said stored position when said upper door is closed, said first tray having a first sidelong edge, a second sidelong edge, a back edge and a primary surface, each of said first sidelong edge and said second sidelong edge being pivotally coupled to an inside surface of a respective one of said first lateral side and said second lateral side of said outer wall of said box at a respective pivot point;

a second tray being pivotally integrated into said box, said second tray being in mechanical communication with said first tray, said second tray being positioned in a deployed position whens said first tray is positioned in said deployed position wherein each of said first tray and said second tray is configured to support the parcel, said second tray being positioned in a stored position when said first tray is positioned in said stored position wherein each of said first tray and said second tray is configured to drop the parcel downwardly in said box, said second tray having a primary sidelong edge, a secondary sidelong edge, a front edge and a primary surface, each of said primary sidelong edge and said secondary sidelong edge being pivotally coupled to said inside surface of a respective one of said first lateral side and said second lateral side of said outer wall of said box at a respective pivot point, said front edge of said second tray being aligned with said back edge of said first tray when said first tray and said second tray are positioned in said deployed position, said primary surface of said first tray lying on a plane being coplanar with said primary surface of said second tray when said first tray and said second tray are positioned in said deployed position;

a pair of linkages, each of said linkages having a first arm being pivotally coupled to a second arm at a pivot point, said first arm having a distal end, said second arm having a distal end, said distal end of said first arm of each of said linkages being pivotally coupled a respective first sidelong edge and said second sidelong edge of said first tray, said distal end of said second arm of each of said linkages being pivotally coupled to a respective primary sidelong edge and said secondary sidelong edge of said second tray, each of said linkages urging said second tray into said deployed position when said first tray is urged into said deployed position, each of said linkages urging said second tray into said stored position when said first tray is urged into said stored position; and an alert unit being integrated into said box, said alert unit being in communication with an interior of said box wherein said alert unit is configured to detect when the parcel falls into said box, said alert unit being in wireless communication with a personal electronic device, said alert unit broadcasting an alert signal to the personal electronic device when said alert unit detects the parcel wherein said alert unit is configured to alert the authorized recipient that the parcel has been deposited into said box, said alert unit comprising:

a control circuit being integrated into said box, said control circuit receiving an alert input;

a motion sensor being positioned within said box wherein said motion sensor is configured to sense motion of the parcel when said parcel falls downwardly in said box, said motion sensor being aligned with said lower door, said motion sensor being electrically coupled to said control circuit, said control circuit receiving said alert input when said motion sensor senses motion;

a transmitter being integrated into said box, said transmitter being electrically coupled to said control circuit, said transmitter being in wireless communication with the personal electronic device, said transmitter broadcasting said alert signal to the personal electronic device when said control circuit receives said alert input; and a power supply being integrated into said box, said power supply being electrically coupled to said control circuit, said power supply comprising at least one battery.

* * * * *